US006705396B1

(12) United States Patent
Ivannikov et al.

(10) Patent No.: US 6,705,396 B1
(45) Date of Patent: Mar. 16, 2004

(54) METHOD AND APPARATUS FOR PRODUCING FLUID CAVITATION

(75) Inventors: Vladimir Ivanovich Ivannikov, Moscow (RU); Ivan Vladimirovich Ivannikov, Moscow (RU)

(73) Assignee: BIP Technology Ltd, Limassol (CY)

( * ) Notice: Subject to any disclaimer, the term of this patent is extended or adjusted under 35 U.S.C. 154(b) by 0 days.

(21) Appl. No.: 10/089,715

(22) PCT Filed: Oct. 2, 2000

(86) PCT No.: PCT/RU00/00392

§ 371 (c)(1),
(2), (4) Date: Apr. 2, 2002

(87) PCT Pub. No.: WO01/25642

PCT Pub. Date: Apr. 12, 2001

(30) Foreign Application Priority Data

Oct. 4, 1999 (RU) ..... 99120729

(51) Int. Cl.[7] ..... F15D 1/02

(52) U.S. Cl. ..... 166/249; 166/304; 166/312; 166/177.6; 166/177.7

(58) Field of Search ..... 166/305.1, 302, 166/249, 304, 312, 177.6, 177.7

(56) References Cited

U.S. PATENT DOCUMENTS 3,373,752 A * 3/1968 Inoue ..... 134/1
3,528,704 A * 9/1970 Johnson ..... 299/14
3,536,263 A * 10/1970 Parker ..... 239/556
3,545,552 A 12/1970 Angona
3,807,632 A 4/1974 Johnson, Jr.
3,905,553 A * 9/1975 Bradley et al. ..... 239/124
4,262,757 A 4/1981 Johnson, Jr. et al.
4,621,931 A 11/1986 Jensen
6,474,349 B1 * 11/2002 Laker ..... 134/22.12

FOREIGN PATENT DOCUMENTS

RU 653435 3/1979

OTHER PUBLICATIONS

I.S. Pearsall, Cavitation, Mills & Boon Ltd., London, 1972, pp. 9–16 (to follow).
R.T. Knapp, J.W. Daily, F.G. Hammitt, Cavitation, McGraw Hill Book Comp., N.Y., 1970, pp. 13–35 (to follow).
"Oil and Gas J.", 1977, 31/X, v. 75, N 45, pp. 129–146 (to follow).
J.W. Daily and D.F. Harleman, Fluid Dynamics, Addison–Wesley Ltd., Ontario, 1966, pp. 418–424 (to follow).

* cited by examiner

*Primary Examiner*—David Bagnell
*Assistant Examiner*—Giovanna Collins
(74) *Attorney, Agent, or Firm*—Collard & Roe, P.C.

(57) ABSTRACT

A method and apparatus for producing fluid cavitation is provided. For a given channel cross-section of a pressure line, the flow is accelerated so as to reach a speed at which $Re > Re_{cr}$, where Re is the Reynolds number and $Re_{cr}$ is the critical Reynolds number; the flow is then interrupted for a time less than half of the phase of the hydraulic shock. The device for cavitation of fluid flow is mounted in the channel of a pressure line and includes a cavitator which has the form of a working body placed in the casing and can move radially inside the line and, to a limited extent, along the axis of the line. The maximum cross-section surface of the working body in a plane perpendicular co the axis of the line is more than 0.8 of the passage of the line but not equal to it.

3 Claims, 3 Drawing Sheets

METHOD AND APPARATUS FOR PRODUCING FLUID CAVITATION

REFERENCE TO RELATED APPLICATIONS

Applicants claim priority under 35 U.S.C. §119 of Russian application No. 99120729, filed Oct. 4, 1999. Applicants also claim priority under 35 U.S.C. §120 of PCT/RU00/00392, filed Oct. 2, 2000. The international application under PCT article 21(2) was not published in English.

FIELD OF THE INVENTION

This invention pertains to hydrodynamics predominantly related to an oil and gas industry and also this invention can be used for other purposes such as eliminating of microbiological objects, cleaning of surfaces from deposits, erosive breaking (pitting) of metals, promoting of chemical reactions, dispersing of solid particles or high molecular compounds into liquid, making emulsions of non-soluble compounds, and in other processes to improve effectiveness of internal mass transfer.

PRIOR ART

A method of cavitation of a liquid is known (I. S. Pearsall, Cavitation, Mills & Boon Ltd., London, 1972, pp. 9–16) which is referred to as vibrational method. It comprises an oscillating body (for example, a magnetostriction vibrator) that generates waves of pressure and decompression in the ambient fluid. At certain magnitude of acceleration (oscillation frequencies) the pressure during the decompression phase reduces down to atmospheric thus providing a rupture of the fluid continuity and a cavitational cavity is formed which collapses during the counter phase.

The main shortcomings of such prior art method are the following:

1. The cavitation zone (i.e. zone of the fluid discontinuity) is localized in the disturbance area adjacent to the oscillating body, though the pressure oscillations spread far remotely to the liquid;
2. The cavitation zone is stationary;
3. As the hydrostatic (external) pressure grows the fluid rupture becomes impossible.

Another method of cavitation of a liquid known as hydrodynamical method (R. T. Knapp, J. W. Daily, F. G. Hammitt, Cavitation, McGraw Hill Book Comp., N.-Y., 1970, pp. 13–35) comprises placing into a fluid flow of a barrier (for example, a body having a shape poorly followed by the flow) at the downstream part of which a zone of reduced pressure is formed. At certain critical speed of the fluid flow the pressure in this zone decreases down to the atmospheric one resulting in generation of bubbles filled by gas or vapor and, further then, a cavity. When the bubbles or cavities coming off the cavitator they pass into the higher pressure zone where they implode releasing some energy which can be usefully applied, for example, for cleaning of inner surface of a conduit from a corrosion layer or carbonate deposit.

This method of cavitation of a liquid is the most relevant by its implementation to the presently claimed one and therefore it is considered as a prior art prototype.

The main shortcomings inherent to the said prototype are the following:

1. The cavitation zone is formed, according to the cavitation number, at certain magnitudes of the flow speed and ambient hydrostatic pressure;
2. The cavitation zone (cavity) is localized and formed along the flowed body (cavitator) and is stationary;

3. It is impossible to rupture the fluid (produce a discontinuity cavity) at higher hydrostatic pressures, for example, the ones that are typical for deep wells.

The devices are known to cavitate a fluid flow (U.S. Pat. No. 4262757, E 21 B 7/18, 1981; "Oil and Gas J.", 1977, 31/X, v. 75, N 45, pp. 129–146) that are made in form of a barrier rigidly fixed in the direction of a flow (transverse bar, curved blade, cone directed counter flow, extensions of the duct into the flow, etc.). Such devices could be considered as analogs. Main shortcomings inherent to these devices are as follows:

1. According to the cavitation number $$\sigma=2(P-Pv)/\rho V^2 \text{ or } \sigma=2(P+\gamma z-Pv)/\rho V^2$$

where P and Pv are, respectively, the pressure values in non-disturbed and disturbed flow; ρ—fluid gravity; z—depth (hydrostatic pressure); V—velocity of the non-disturbed flow respectively to the cavitator, γ=pg, where g is free falling acceleration.

It follows that too high fluid pumping rate is required to provide a rupture of a flow continuity which rates are difficult to obtain, especially in deep wells or long pipelines;

2. It appears to be impossible to obtain cavitation due to such devices at high hydrostatic pressure values, for example in deep wells.

The devices are also known, for example (J. W. Daily and D. F. Harleman, Fluid Dyamics, Addison-Wesley Ltd., Ontario, 1966, pp. 418–424) comprising a cavitator in the form of a ball rigidly fixed on a rode placed in the downstream part of the flow which device could be considered as a prior art prototype due to that it is the most close by its designing principles to the presently claimed ones.

Main shortcomings inherent to this prior art prototype are:

1. Ball closes less than 0.8 of the cross-section area of the conduit and is motionless, and therefore either very high fluid pumping rates or the corresponding narrowing of the conduit (as it is usually employed in hydrodynamic setups to model the cavitation) is required to obtain cavitation and produce a cavitation cavity;
2. If a cavitation is obtained and the cavitation cavity is formed, such cavity will not come off the cavitator since it is stationary, and as a result, it is impossible to provide the effective action of cavitation on the surrounding bodies at a phase of imploding of the bubbles and cavities;
3. Applying of excessive external or internal pressure results in degeneration of cavitation (boiling of the liquid behind the cavitator), where just an underpressure zone will take place only.

SUMMARY OF THE INVENTION

The present method of cavitation of a flow of liquid appears to be the hydrodynamical one by its nature. The method is realized under the following conditions: the flow in a given cross-section of the higher pressure delivery conduit is to be accelerated to a velocity at which $Re>Re_{cr}$, where Re—Reynolds number, $Re_{cr}$—critical Reynolds number, and then the flow is interrupted during a time less than duration of a half of semi-period of the liquid hammer. Due to such interruption, full or partial, a rupture of the fluid flow is provided. The selection of the interrupt time less than semi-phase of a liquid hammer excludes the liquid hammer that is potentially harmful for the pressure part (manifold) of the conduit. To facilitate the fluid flow rupturing at higher hydrostatic pressure the nuclei of cavitation can be introduced into the pumped fluid such as gas bubbles or dispersion of solid particles or emulsion of an insoluble liquid.

The claimed device to cavitate the fluid flow in the delivery conduit comprises a cavitator made in the form of a working body placed in the channel of the conduit and said body has an opportunity to move in a radial direction of the conduit (casing) and is restricted to move along the axial direction of the conduit, and maximal area of cross section of the working body in a plane, perpendicular to axis of the conduit is more than 0.8 of the cross-section of the conduit but not equal to it.

The claimed method of cavitation employs the kinetic energy of a fluid flow that, as it is known, is a function of a mass and velocity of a moving liquid. At a bigger length of a pipeline the force applied to rupture a fluid can reach very high values thus enabling the solution of a task to obtain cavitation at higher hydrostatic pressure. In wells of 3000–5000 m by depth the hydrostatic pressure is equal to 300–500 kg/sq.cm and more, and it is practically impossible to produce cavitation under such conditions due to vibrations or just high pumping rates. Similar conditions of high hydrostatic pressure can take place in the on-land pipelines also.

The free turbulent vortexes nucleate the cavitation, i.e. create in the flowing liquid the local underpressure zones. These vortexes concentrate the gas dissolved in the liquid thus promoting the development of cavitation. Injection into a fluid of gas bubbles, solid particles or emulsions of an insoluble liquid boost the said effect.

BRIEF DESCRIPTION OF THE DRAWINGS

The invention is illustrated in the FIGS. 1–12 where the devices are presented with different geometry of a working body to implement the claimed method of cavitation of a fluid flow at higher hydrostatic pressures, and specifically in the deep wells.

DETAILED DESCRIPTION

A working body 2 is placed inside the conduit 1 in a fluid flowing in the direction as indicated by arrows. The limiter of axial motion 3 is made in a form of a support.

Figure 1:
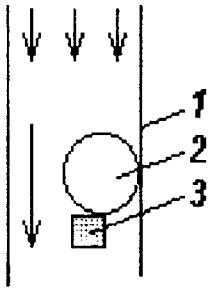
FIGS. 1–4 show the working body made in the form of a ball.
Figure 2:
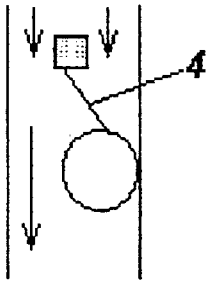
Figure 3:
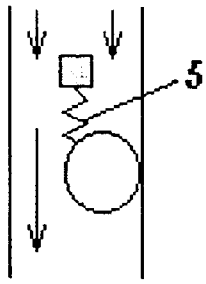
Figure 4:
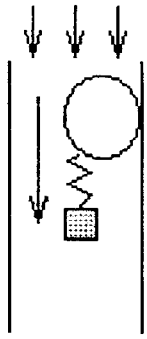
Figure 5:
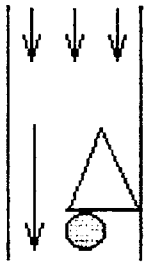
FIGS. 5–8 show the working body made in the form of a cone.
Figure 6:
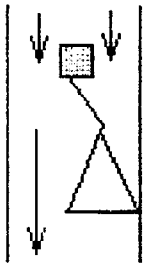
Figure 7:
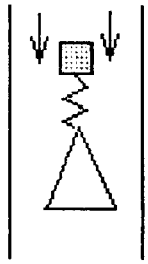
Figure 8:
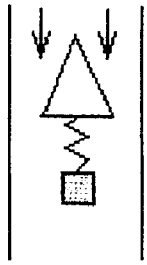
Figure 9:
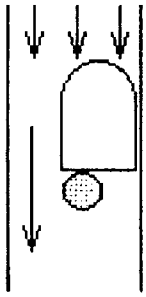
FIGS. 9–12 show the working body made in the form of a cylinder.
Figure 10:
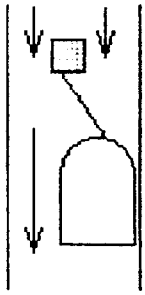
Figure 11:
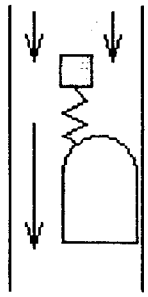
Figure 12:
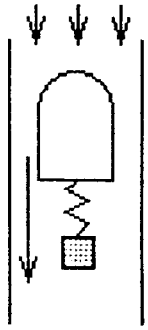

In the FIGS. 1, 5 and 9 the working body 2 is placed on a support 3, in the FIGS. 2, 6 and 10 the working body 2 is connected to the support 3 via a flexible bound 4, in the FIGS. 3, 7 and 11 the working body 2 is placed under the support 3 and connected to it via a spring 5, in the FIGS. 4, 8 and 12 the working body is placed over the support 3 and connected to it via a spring 5.

Figure 13:
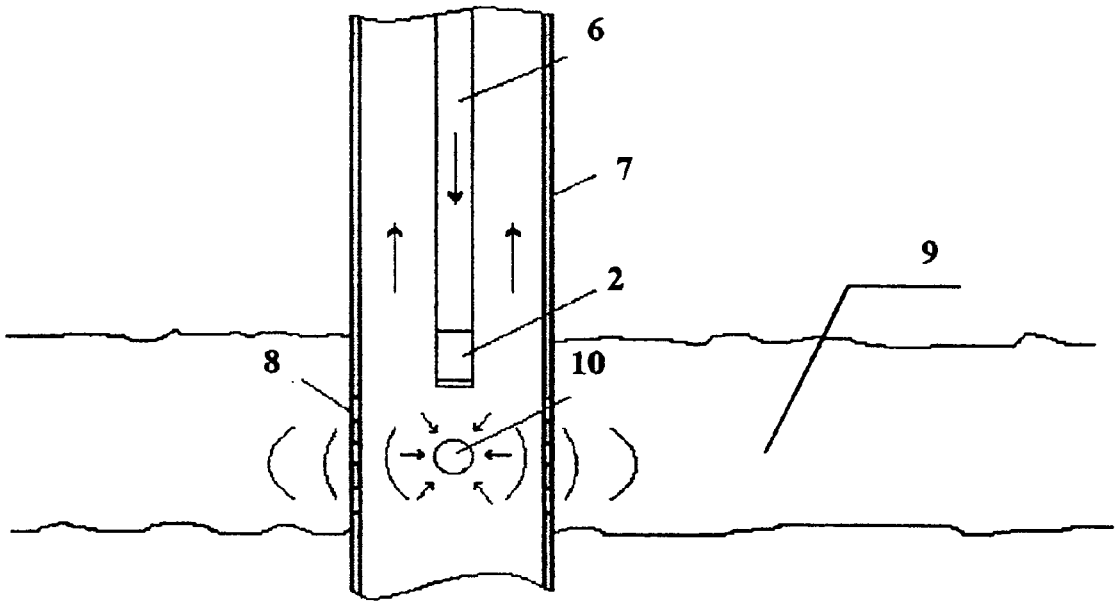
FIG. 13 shows an example of realization of the invention in a well.

When employing the proposed method (FIG. 13) to create cavitation voids 10 in a fluid flowing inside a casing pipe 7 having perforation holes 8 for hydraulic connection to a rock 9 bearing the fluids (oil, gas, water) a column of tubes 6 is used as a fluid delivery conduit 1 to the working body (cavitator) 2.

Figure 14:
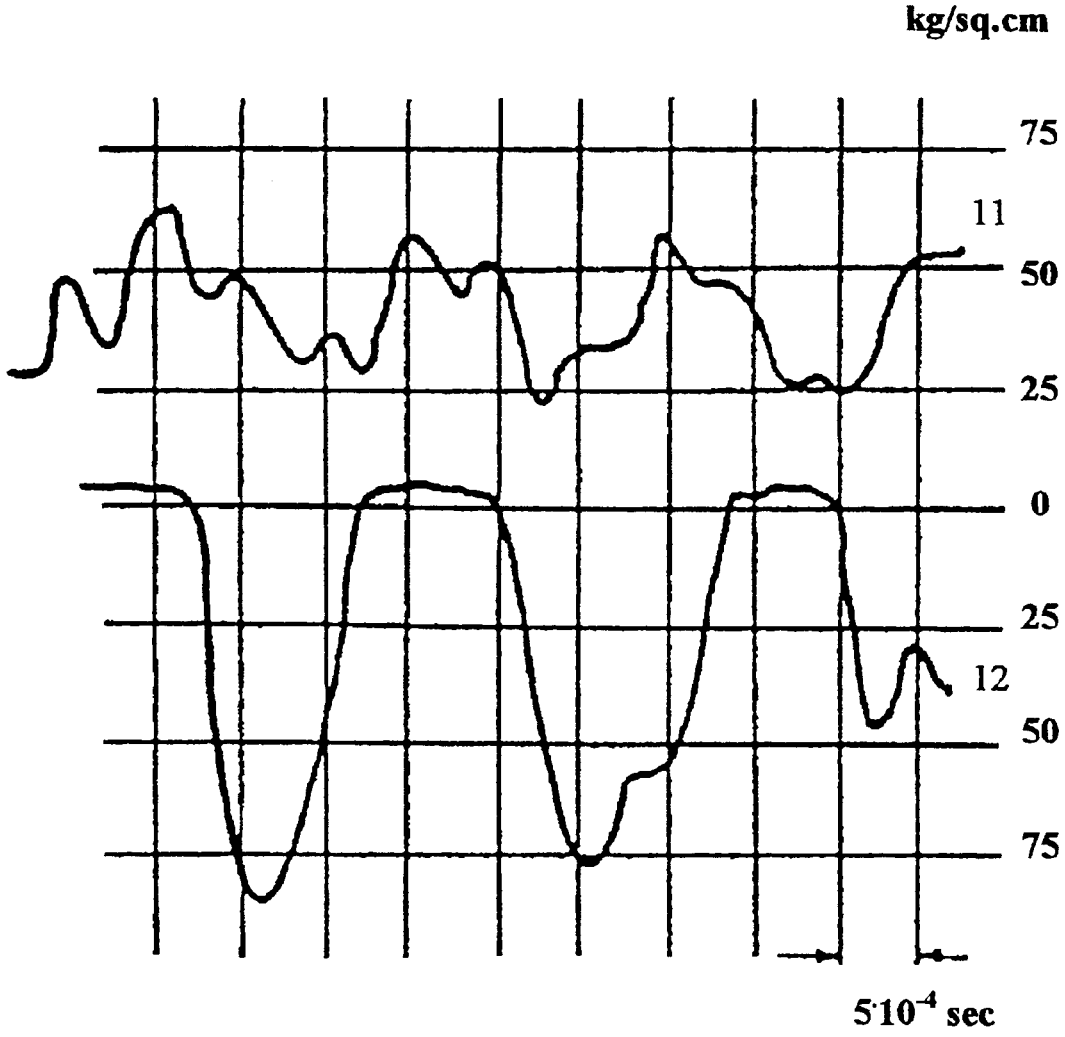
FIG. 14 shows the oscillograms of working pressure pulsations at upper and lower parts of the cavitator recorded at a laboratory setup.

The FIG. 14 testifies the fact of discontinuity of the fluid flow behind the cavitator and forming of cavities. In this FIG. 14 an oscilloscope recordings of pressure pulsations are shown as obtained in the setup comprising two inertialess pressure sensors placed, respectively, in a point over the ball working body (upper sensor) and under it (lower sensor). The pumping rate of fluid through the delivery pipe conduit was 13.6 liters per sec, pressure at a distance of more than 3 m counter flow from the working body 2 was P=40 kg/sq.cm. In said experiments a steel ball of 76 mm by diameter was used as a working body placed free on a rigid support 3 providing the closing ratio of the conduit channel of 0.85. The discontinuity of the flow (formation of the cavitation cavities) is proved by the record of the lower sensor which shows crossing by signal of a zero pressure line.

For cavitator suspended on a support 3 via spring 5 or placed on a support 3 via spring 5, an opportunity is provided for a more complete separation of the cavitation cavities from the working body 2 due to longitudinal oscillations of the last. The frequency of the longitudial oscillations could be derived from an equation $S=f*d/V$, where S—Strouchal number, f—frequency rate of the cavities separation, V—velocity of the flow, d—diameter of the cavitator. The Strouchal number (dimensionless criteria) is derived as a ratio of diameter of the cavitator to diameter of the conduit channel. Force of the spring shall be selected from a condition that the natural frequency of oscillations of cavitator to be close to the frequency of the frequency rate of the turbulent disturbance of the flow.

EXAMPLE

Employing one of the devices shown in the FIG. 1 as a fluid flow interrupter one can produce hydro fracturing of porous rock in the borehole.

Standard hydrofracturing of the rock in boreholes is produced via setting of a packer in the annulus above the perforation zone and injecting of a liquid into the under-packer zone at a pressure higher than the rock pressure and the rock rupture strength. As a result of that the liquid penetrating into incipient cracks in the rock broaden and deepen them in radial direction. To prevent closing of the cracks they are fixed by sand or other propant.

The practices are also known to produce the rock fracture by shock waves (for example, USSR Certificate of Authorship N 973805, E 21 B 43/26, 1982 or other). Shock wave having high peak magnitude is capable to rupture a rock, provided the wave front is directed by normal to the borehole wall acting through the perforation holes in a casing. However the effect of a shock wave lasts only few milliseconds and this time is too short to allow the liquid to fill the cracks. As a result the cracks close.

Cavitation of a fluid flow pursuant to the proposed method allows not to use setting a packer over the perforation zone (as shown in the FIG. 13) and generate radially (rather than tangentially) directed shock waves at maximally possible repetition rate. It is high (about 4 kHz) repetition rate of 'pumping' of the cracks what prevents their closing and enables further development (spreading and branching) of cracks long apart from the well. Due to this effect drainage of the bottom hole zone is provided thus increasing the well inflow or injection capacity by up to several times.

Another very important advantage of the claimed method is that the cavitation of the fluid flow employing the cavitator devices mounted at the bottom end of an injection tube column leads to generation and injecting of the cavitation cavities into a well (where they implode) while the positive pulse of pressure (pressurized stack) is retained within the column. So the imploding of the cavities provides the removal from the rock of colmatants that were closing the inflow channels.

Also the cavitation of a fluid flow allows to treat an inner surface of a tubing and bottom hole zone of a well to remove the carbonaceous or paraffinaceous deposits.

Cavitation allows a local or spatially selective treatment of oil bearing rock to improve inflow from it without affecting the water influx zoned resulting in reduction of water content in the produced oil.

The cavitational treatment can last long enough to effect of increase of inflow in production wells due to treatment of injection wells nearby.

Cavitation of a fluid flow at high values of hydrostatic pressure provides an opportunity to control the process of a rock breaking when drilling it with a bit. For example, the tests showed that for drilling with a rolling cutter drill bit the drilling rate was increased by up to twice and the bit life extended by up to 1.5 times.

Also cavitation of a fluid flow enables low temperature boiling of a pumped liquid thus providing an opportunity to decompose at some excessive pressure the high-weight molecular structures and refine the oil stock or its residual to improve the yield of lighter and volatile components. The carried out experiments show that one can extract up to 10–15% of lighter fractions from a residual oil.

APPLICABILITY IN INDUSTRY

This invention can be employed in a borehole to effect the oil-bearing rocks to increment the oil inflow or injectivity; to effect the bottom hole of a well during drilling to stimulate the process of breaking the drilled rock.

In the first embodiment, a casing of a said device was mounted at the bottom end of tubing and then descended with it into a well to a perforation depth. After washing the well off a ball of a correspondent diameter was dropped into an inner space of the tubing column. Fluid was pumped until the ball is set on a support restricting further axial motion within the device casing. Then the hydraulic pumps were connected to a tubing column to provide pumping rate sufficient to operate the device. The treatment of the rock was continued during 6 hours at a pumping rate of Q=20 liters per second. The estimated pulse repetition rate was 4800 Hz.

The results of treatment are as follows: oil inflow rate was increased by 2.6 times.

In the second embodiment used for rotor drilling a bit sub was mounted above the bit and inside of which a cone shaped cavitator was placed. The goal of the test was to estimate the effect of the cavitational regime of washing on effectiveness of breaking the rock by a rolling cutter drill bit. The drilling was carried out at a depth of 1624–1950 meters through the monotypic argillite packs at a weight on the bit of 18 tons. Bit rotation was 65 rpm, pumping rate was 30–35 liters per second. A clayey drilling fluid was used of 1.17 g/cub.cm by gravity and viscosity of 30 sec as measured using a SPV-5 cone.

The results of the claimed method implementation in comparative conditions are as follows: the life of drill bit was extended from 168 meters to 319 meters and drilling rate was increased from 1.65 meters per hour to 3.5 meters per hour.

What is claimed is:

1. Device to cavitate flow of a fluid in a delivery conduit containing a hydrodynamical cavitator which hydrodynamical cavitator comprises a working body placed in the channel of the conduit and having an opportunity to move freely in any radial direction of the conduit and a restriction of motion in axial direction of the conduit, and the area of maximal cross section of said working body in a plane, perpendicular to axis of said conduit is more than 0.8 of the cross-section of the conduit but not equal to it.

2. A method for producing fluid cavitation in a delivery conduit comprising the steps of:

(a) pumping a fluid through the delivery conduit;

(b) placing withing said conduit a cavatating element comprising a working body radially movable inside the conduit and to a limited extent movable along an axis of the conduit, said working body having a maximum cross-section surface in a plane perpendicular to the axis of the conduit greater than 0.8 of, but not equal to, the cross-section of the conduit;

(c) accelerating fluid flow in a respective cross-section of a channel of the delivery conduit to a speed at which $Re>Re_{cr}$, where Re is the Reynolds number and $Re_{cr}$ is the critical Reynolds number; and (d) interrupting the flow for a time less than half-phase of hydraulic hammer.

3. The method of claim 2 further comprising introducing nuclei of cavitation into the fluid selected from the group consisting of gas bubbles, a dispersion of solid particles, and an emulsion of insoluble liquid.

* * * * *